United States Patent [19]

Whitcomb

[11] Patent Number: 4,829,046

[45] Date of Patent: May 9, 1989

[54] POSITIVE-ACTING THERMOGRAPHIC MATERIALS

[75] Inventor: David R. Whitcomb, Maplewood, Minn.

[73] Assignee: Minnesota Mining and Manufacturing Company, St. Paul, Minn.

[21] Appl. No.: 108,800

[22] Filed: Oct. 15, 1987

[51] Int. Cl.[4] ..... B41M 5/18

[52] U.S. Cl. ..... 503/211; 427/150; 428/704; 428/913; 503/200; 503/217; 503/226

[58] Field of Search ..... 503/200, 211, 217, 226; 427/150–152; 428/704, 913

[56] References Cited

U.S. PATENT DOCUMENTS

| | | | |
|---|---|---|---|
| 2,663,654 | 12/1953 | Miller et al. | 117/36 |
| 3,094,620 | 6/1963 | Reitter | 250/65 |
| 3,111,423 | 11/1963 | Ostlie | 117/36.8 |
| 3,293,055 | 12/1966 | Baum | 106/171 |
| 3,483,143 | 12/1969 | King et al. | 260/2 |
| 3,829,401 | 8/1974 | Futaki et al. | 268/38 |
| 3,846,153 | 11/1974 | Futaki et al. | 117/36.9 |
| 3,953,659 | 4/1976 | Truitt | 428/511 |
| 4,049,612 | 9/1977 | Sandler | 268/31.8 R |
| 4,531,141 | 7/1985 | Sagawa | 346/209 |
| 4,533,930 | 8/1985 | Shioi et al. | 346/211 |
| 4,602,264 | 7/1986 | Shioi et al. | 503/211 |
| 4,704,379 | 11/1987 | Shioi et al. | 503/211 |

OTHER PUBLICATIONS

J. Inorg. Nucl Chem. 1968, vol. 30, pp. 1553–1561, "The Infra-Red Spectra of Complexes of Beryllium with Tri-n-octylphosphine Oxide and Di(2-ethylhexyl) Phosphoric Acid", L. E. Smythe, T. L. Whateley and R. L. Werner.

Chemistry and Industry Jul. 2, 1955, "The Hydrolysis of Organic Phosphates", pp. 760–763, P. W. C. Barnard, B.Sc., C. A. Bunton, Ph.D., D. R. Llewellyn, Ph.D., K. G. Oldham, B.Sc., B. L. Silver, B.Sc., and C. A. Vernon, B.Sc.

Inorganic Chemistry, vol. 8, No. 9, Sep. 1969, "Electronic Equilibrium Between the $A_1$ and $T_2$ States in Iron(III) Dithio Chelates", pp. 1837–1846, A. H. Ewald, R. L. Martin, E. Sinn and A. H. White.

J. Am. Chem. Soc. 1985, 107, 4094–4095, "High Dilution Synthesis of Macrocyclic Polycatecholates", Steven J. Rodgers, Chiu Yuen Ng and Kenneth N. Raymond.

J. Am. Chem. Soc. 1958, 74, 2995–2997, "Unsymmetrical Dialkylphosphinic Acids", P. C. Crofts and I. S. Fox.

J. Am. Chem. Soc. 1934, pp. 1678–1681, "The Condensation of Catechol with Acetone", Wilson Baker.

Journal of Chemical Education, vol. 45, pp. 581–587, Sep. 1968, "Hard and Soft Acids and Bases", HSAB, Part 1, Fundamental Principles, Ralph G. Pearson.

*Primary Examiner*—Bruce H. Hess

*Attorney, Agent, or Firm*—Donald M. Sell; Walter N. Kirn; Mark A. Litman

[57] ABSTRACT

A positive-acting thermographic material which is black or dark colored in the unexposed condition turns white or light colored when exposed to elevated temperatures. The material comprises a binder, a dark colored complex of ferric iron with a ligand chosen from organothiophosphorus acids, and a white organophosphorus acid or its alkali or alkaline earth metal salt. At elevated temperatures a double decomposition reaction occurs giving the light colored complex of ferric iron with the organophosphorus acid.

7 Claims, No Drawings

POSITIVE-ACTING THERMOGRAPHIC MATERIALS

BACKGROUND TO THE INVENTION

1. Field of Invention

The invention relates to thermographic materials and in particular to positive acting materials. By this is meant that such materials are dark or colored before exposure to heat and turn colorless or at least lighter in color when thermally addressed.

2. Background of the Art

Heat-sensitive imaging sheets have been used for copying, thermal printing, thermal recording, and thermal labeling. Many of these materials involve thermally increasing the reactivity of two or more coponents of a color forming reaction which do not react at normal ambient temperatures. Reactivity is often enhanced by melting of one or both reactants which are physically separated from one another. This separation is usually accomplished either by dispersion in a single coated layer or by being situated in two different coated layers. Several general classes of color forming reactants have been used, of which two common ones are (a) leuco lactone or spiropyran compounds reactable with phenolic compounds (e.g., U.S. Pat. Nos. 3,829,401 and 3,846,153) and (b) heavy metal salts of organic acids reactable with ligands to give colored complexes (e.g., U.S. Pat. Nos. 2,663,654, 3,094,620, 3,293,055 and 3.953,659).

Commercial preference for the transition metal salt class has often resulted from the high stability and near black color of the images produced (U.S. Pat. No. 4,531,141). Of the transition metals used, iron, nickel, and cobalt are common and ferric iron appears to be one of the most preferred (U.S. Pat. No. 2,663,654, 3,953,659, 4,531,141).

No references have been found in the literature to thermographic systems having a positive mode of action as defined above. Such systems require a normally black or heavily colored sheet to be turned substantially colorless by exposure to heat.

Black complexes of iron are numerous but normally do not easily react to a colorless form under heat or other stimulation. In U.S. Pat. No. 4,533,930 organo-thiophosphates, organo-thiophosphinates, and organo-thiophosphonates of ferric iron are disclosed as reacting with chelates to give products of different color, normally darker. In fact many of these thio materials are substantially black themselves.

This present invention shows how such black thio compounds can be used to make positive acting thermographic materials.

SUMMARY OF THE INVENTION

The invention provides a positive acting thermographic material comprising a clear binder in which is dispersed or dissolved (a) a dark colored complex of ferric iron with ligands chosen from organothiophosphates, organothiophosphinates, and organothiophosphonates, and (b) an acid moiety chosen from organophosphoric, organophosphinic, and organophosphonic acids. The acid moiety can be derived from the free acid or from a salt thereof.

An aspect of the invention is to provide a thermographic material which responds to heat to give colorless image areas on a dark or black ground.

DETAILED DESCRIPTION OF THE INVENTION

In this invention a ferric iron complex selected from (I)

$$Fe[S_2P(OR)_2]_3 \qquad (I)$$

$$Fe[S_2P(\underset{\underset{R}{|}}{OR})]_3$$

$$Fe[S_2PR_2]_3$$

wherein the two R substituents are independently chosen from alkyl, cycloalkyl, alkaryl, and aryl, and substituted versions of these moieties providing that the substituents do not result in the creation of chelating sites, reacts under the influence of heat with an organophosphorus acid or its salt selected from those of the form (II)

$$M^+[^-OOP(OR')_2] \qquad (IIa)$$

$$M^+[^-OOP(\underset{\underset{R'}{|}}{OR'})]$$

$$M^+[^-OOPR'_2]$$

$$M^+[^-OOP(OR')O^-]M^+$$

$$M^+[^-OOPR'O^-]M^+$$

wherein the R′ substituents are independently chosen from alkyl, cycloalkyl, alkaryl, and aryl, and substituted versions of these substituents providing that they do not result in the creation of chelating sites, and M is chosen from H, $NH_4$, Na, and K, or $$M^{++}[^-OOP(OR')_2]_2 \qquad (IIb)$$

$$M^{++}[^-OOP(\underset{\underset{R'}{|}}{OR'})]_2$$

$$M^{++}[^-OOPR'_2]_2$$

$$M^{++}[^-OOP(OR')O^-]$$

$$M^{++}[^-OOPR'O^-]$$

wherein R′ is as above, and

M is chosen from Ca and Mg.

The reactants (I) and (II) may be dispersed as separate microparticles in a binder and coated as a thin layer on a support, or may be dispersed in separate adjacent layers, or either of the compounds (I) or (II) may be in solid solution in the binder of one layer also containing the other compound in microparticulate form, or finally each of the compounds (I) and (II) may be in solid solution in the same layer or in a separate layer adjacent to the other. On heating, double decomposition occurs, for example as follows:

$$Fe\,[S_2P(OR)_2]_3 + H-[OOPR'_2]$$

$$Fe\,[OOPR'_2]_3 + H-[S_2P(OR)_2]$$

The factors which are favorable to this reaction rather than its reverse are as follows:

(a) oxygen donors are hard (do not surrender electrons as easily) compared with sulfur donors with respect to $Fe^{+++}$ which ensures that the oxygen analogues will normally replace the thio acid moieties in the iron complex;

(b) the pKa of phosphates etc. are lower than those of the thio equivalents which again will lead to the replacement of thio moieties by their oxygen equivalents;

(c) the oxygen analogues form oligomeric iron complexes which are relatively inert and push the reaction in their direction.

In the choice of the R substituents for the thio moieties when M=H, the lower alkyl groups are least preferred because the free acids formed under the influence of heat are volatile and of disagreeable odor.

Tri-substituted versions of the acid moieties in both (I) and (II) are not useful by themselves in this invention because they are highly susceptible to hydrolysis and are unstable under normal atmospheric conditions.

The ferric iron complexes of formula (I) may be made by reacting an aqueous solution of the thioorganic phosphorus acid with an aqueous solution of a ferric salt of a strong acid, preferably nitric acid, under acid conditions. Alternatively, the two reactants may be dissolved in glacial acetic acid for reaction. The pH tends to drop with the production of nitric acid during the reaction which in turn results in the production of ferrous ions; these slowly initiate the catalysis of the reduction of the counter ion $NO_3^-$ to $NO_2/N_2O_4$ and result in an undesired reaction product. Rapid reaction (less than 30 minutes reaction time), use of the ammonium salt of the organothiophosphorus acid, or the addition of sodium acetate to react with the nitric acid prevents this problem arising.

Binders suitable in this invention are acrylic polymers such as acrylates and methacrylates and their copolymers, vinyl resins, styrene resins, cellulose resins, polyester resins, urethanes, alkyl resins, silicones, and epoxy resins. Generally they must be miscible with nonaqueous solvents and have a melting point above the reaction temperature of the ferric complex and organophosphorus acid or its salt. The binder should also be transparent.

Coating compositions suitable to make a thermal recording sheet can be made by dissolving the ferric complex (I) in a solvent such as acetone, methyl ethyl ketone, ethanol, etc. To this solution a polymer binder is added and the resulting solution is first coated by wire wound bar on a support. The acid (II) is dissolved in a suitable solvent like those above and a polymer binder added and agitated until dissolved. This solution is then coated over the dried first coating and dried. An interlayer may optionally be coated between the layers to reduce reactivity at room temperatures. By choosing the reactants I and II to have low room temperature reactivity or by mixing and coating at temperatures below room temperature, both reactants may be dissolved in the same polymer layer. As another approach, microparticles of the reactants dispersed in solvent in which they are not soluble can reduce the number of coated layers to one and at the same time reduce reactivity at room temperatures.

The coating composition coated on a suitable substrate may be dried at temperatures below thermal reaction temperatures.

Substrates which may be used are films of transparent, opalescent, or opaque polymers, paper, optionally with white or colored surface coatings, glass, ceramic, etc. The substrate must be stable and undistorted at the thermal reaction temperatures which are preferably between 60° and 200° C. and more preferably between 80° and 150° C.

Image formation using these materials may be accomplished by thermal imaging methods well-known in the art. These include using focused infrared radiation, thermal printing heads, or contact with an original document while illuminating uniformly with infrared radiation absorbed by the characters on the document.

The following examples illustrate the invention.

EXAMPLE 1

Preparation of a (green-black) color-to-colorless thermal imaging construction.

A solution of 0.5 g $Fe(S_2P(\text{-O-ethyl})_2)_3$ (obtained from $Fe(NO_3)_3.9H_2O$ and diethyldithiophosphate in acetic acid) in 5 g 10% VYNS (e.g., vinylchloride/vinyl acetate copolymer from Union Carbide) in methylethylketone is coated 1.4 mils wet with a wire wound bar on a polyester film and air dried. On top of this coating is coated a 1.4 mil film of a solution of 1.5 g di-n-dodecylphosphate in 10 g of 10% Klucel E in ethanol. A coating having a 1.9 reflectance optical density is obtained. Upon thermal imaging, a clear, substantially colorless image is obtained (reflectance optical density of 0.3).

EXAMPLE 2

The same coating as in Example 1 but with the layers reversed provides a similarly acting construction.

EXAMPLES 3–5

The same coatings as in Examples 1 or 2, but with ethylphosphonic acid, phenylphosphonic acid or phenylphosphinic acid, gives an even loss colored image.

I claim:

1. A positive-acting thermographic sheet comprising a substrate having coated on at least one surface thereof a coating comprising at least one layer of clear binder having independently dissolved or dispersed therein a positive-acting thermographic material comprising, in thermographically reactive association, a) a dark colored complex of ferric iron with a ligand chosen from organothiophosphates, organothiophosphinates, and organothiophosphonates, and b) a source of a moiety chosen from organophosphate, organophosphinate, and organophosphonate, said source being chosen from the group consisting of a free acid and a salt of a free acid containing said moiety.

2. A positive-acting thermographic sheet according to claim 1, wherein said coating comprises a first and second layer of said binder, said first layer containing said complex and said second layer containing said source of said moiety.

3. A positive-acting thermographic sheet according to claim 2 wherein said coating further comprises an interlayer comprising a binder situated between said first and said second layers.

4. A positive-acting thermographic sheet according to claim 1, wherein said dark colored complex is chosen from the group defined by the general formulae $$Fe[S_2P(OR)_2]_3$$

$$Fe[S_2P\underset{\underset{R}{|}}{O}R]_3 \text{ and}$$

-continued $Fe[S_2PR_2]_3$ wherein the R substituents are independently chosen from alkyl, cycloalkyl, alkaryl, and aryl, and substituted versions of these moieties providing that said substituents do not result in the creation of chelating sites.

5. A positive-acting thermographic sheet according to claim 1, wherein said source of said moiety is chosen from those having the general formulae $M^+[^-OOP(OR')_2]$ $M^+[^-OOPOR']$ (R')

$M^+[^-OOPR'_2]$ $M^+[^-OOP(OR')O^-]M^+$ $M^+[^-OOPR'O^-]M^+$ wherein the R′ substituents are independently chosen from alkyl, cycloalkyl, alkaryl, and aryl, and substituted versions of these substituents providing that said substituents do not result in the creation of chelating sites, and M is chosen from H, $NH_4$, Na, and K, and $M^{++}[^-OOP(OR')_2]_2$ $M^{++}[^-OOPOR']_2$ (R')

$M^{++}[^-OOPR'_2]_2$ $M^{++}[^-OOP(OR')O^-]$ $M^{++}[^-OOPR'O^-]$ wherein R′ is as above, and M is chosen from Ca and Mg.

6. (New) A positive-acting thermographic sheet according to claim 1, wherein said dark colored complex is chosen from the group defined by the general formulae $Fe[S_2P(OR)_2]_3$ $Fe[S_2POR]_3$ (R) and $Fe[S_2PR_2]_3$ wherein the R groups are independently chosen from alkyl, cycloalkyl, alkaryl, and aryl, and substituted versions of these moieties bearing only non-chelating substituents.

7. A positive-acting thermographic sheet according to claim 1, wherein said source of said moiety of chosen from those having the general formulae $M^+[^-OOP(OR')_2]$ $M^+[^-OOPOR']$ (R')

$M^+[^-OOPR'_2]$ $M^+[^-OOP(OR')O^-]M^+$ $M^+[^-OOPR'O^-]M^+$ wherein the R′ groups are independently chosen from alkyl, cycloalkyl, alkaryl, and aryl, and substituted versions of these moieties bearing only non-chelating substituents, and M is chosen from H, $NH_4$, Na, and K, and $M^{++}[^-OOP(OR')_2]_2$ $M^{++}[^-OOPOR']_2$ (R')

$M^{++}[^-OOPR'_2]_2$ $M^{++}[^-OOP(OR')O^-]$ $M^{++}[^-OOPR'O^-]$ wherein R′ is as above, and M is chosen from Ca and Mg.

* * * * *